US005295807A

United States Patent [19]

Wiley et al.

[11] Patent Number: 5,295,807

[45] Date of Patent: Mar. 22, 1994

[54] VARIABLE OUTPUT PUMP ADJUSTMENT MECHANISM

[75] Inventors: Ronald L. Wiley; John H. Bearden, both of Marietta, Ga.

[73] Assignee: The Coca-Cola Company, Atlanta, Ga.

[21] Appl. No.: 24,703

[22] Filed: Mar. 1, 1993

[51] Int. Cl.[5] ..... F04B 49/00

[52] U.S. Cl. ..... 417/274; 417/439

[58] Field of Search ..... 417/274, 439, 540; 92/60

[56] References Cited

U.S. PATENT DOCUMENTS

| | | | |
|---|---|---|---|
| 297,400 | 4/1884 | Holcombe | 417/486 |
| 1,475,508 | 11/1923 | Esnault-Pelterie | 417/274 X |
| 1,997,476 | 4/1935 | Wallene | 417/274 |
| 2,047,167 | 7/1936 | Heller | 417/274 X |
| 2,327,787 | 8/1943 | Heintz | 417/486 |
| 2,937,523 | 5/1960 | Yoler | 417/486 |
| 3,084,847 | 4/1963 | Smith | 417/274 |
| 3,739,810 | 6/1973 | Horan, Jr. | 137/568 |
| 3,795,464 | 3/1974 | Backman | 417/274 X |
| 3,884,125 | 5/1975 | Massie | 417/274 |
| 4,152,786 | 5/1979 | Clark | 138/31 |
| 4,431,379 | 2/1984 | Langdon | 417/274 |
| 4,560,326 | 12/1985 | Seki | 417/274 |
| 4,594,059 | 6/1986 | Becker | 417/439 |

FOREIGN PATENT DOCUMENTS

| | | | |
|---|---|---|---|
| 0471216 | 1/1929 | Fed. Rep. of Germany | 417/439 |

*Primary Examiner*—Richard A. Bertsch
*Assistant Examiner*—Alfred Basichas
*Attorney, Agent, or Firm*—Birch, Stewart, Kolasch & Birch

[57] ABSTRACT

An auxiliary chamber is connected to the main pumping chamber of a liquid dispensing pump. The auxiliary chamber includes a resilient rolling diaphragm in fluid communication with the fluid in the main pumping chamber and is expandable for receiving liquid from the main pumping chamber during an output stroke with an adjustable stop member being located behind the diaphragm for restricting the displacement of the diaphragm by the volume of fluid entering the secondary chamber from the pumping chamber and thus controlling the output from the pump by controlling the net internal pump chamber volume.

4 Claims, 5 Drawing Sheets

VARIABLE OUTPUT PUMP ADJUSTMENT MECHANISM

BACKGROUND OF THE INVENTION

1. Field of the Invention

This invention relates generally to variable displacement pumps and more particularly to a variable volumetric output adjustment means for a concentrate pump utilized in a pre-mix liquid dispensing system.

2. Description of the Prior Art

Variable displacement pumps are generally known and involve many types of configurations. Examples of such apparatus include the variable displacement pump shown and described in U.S. Pat. No. 2,327,787, issued to R. M. Heintz on Aug. 24, 1943, and the output regulating means disclosed in U.S. Pat. No. 1,475,508, issued to R. Esnault-Pelterie on Nov. 27, 1923. Also an adjustable clearance mechanism for compressors is disclosed in U.S. Pat. No. 2,047,167 issued to H.C. Heller on Jul. 7, 1936. While such apparatus is considered to operate as intended for their specific applications, such apparatus nevertheless includes inherent limitations and is generally unsuitable for use in connection with a ratio proportioning pump that mechanically provides two liquids dispensed to a mixing valve of a post-mix dispenser at exact ratios and cannot readily be added to existing ratio proportioning liquid dispensing pumps.

SUMMARY

It is a primary object of the subject invention, therefore, to provide an improvement in variable output displacement pumps.

It is a further object of the invention to provide an improvement in concentrate pumps for liquid dispensing systems.

It is another object of the invention to provide a liquid dispensing assembly for providing a variable volumetric output adjustment for a concentrate pump for feeding two liquids dispensed to a mixing valve at selectively adjustable ratios.

And it is yet another object of the invention for converting an otherwise non-adjustable ratio proportioning pump that mechanically provides two liquids dispensed to a mixing valve at exact ratios into a proportioning pump having an adjustable ratio setting.

Briefly, the foregoing and other objects of the invention are realized by coupling an auxiliary chamber to the main pumping chamber of a liquid dispensing pump where the auxiliary chamber includes a resilient rolling diaphragm in fluid communication with the fluid in the main pumping chamber and which is expandable for receiving liquid from the main pumping chamber during an output stroke with an adjustable stop member being associated with the diaphragm for restricting the displacement of the diaphragm by the volume of fluid entering the secondary chamber from the pumping chamber and thus controlling the output from the pump by controlling the net internal pump chamber volume.

BRIEF DESCRIPTION OF THE DRAWINGS

The following detailed description of the invention more readily understood when considered together with the accompanying drawings in which.

DETAILED DESCRIPTION OF THE INVENTION

Figure 1:
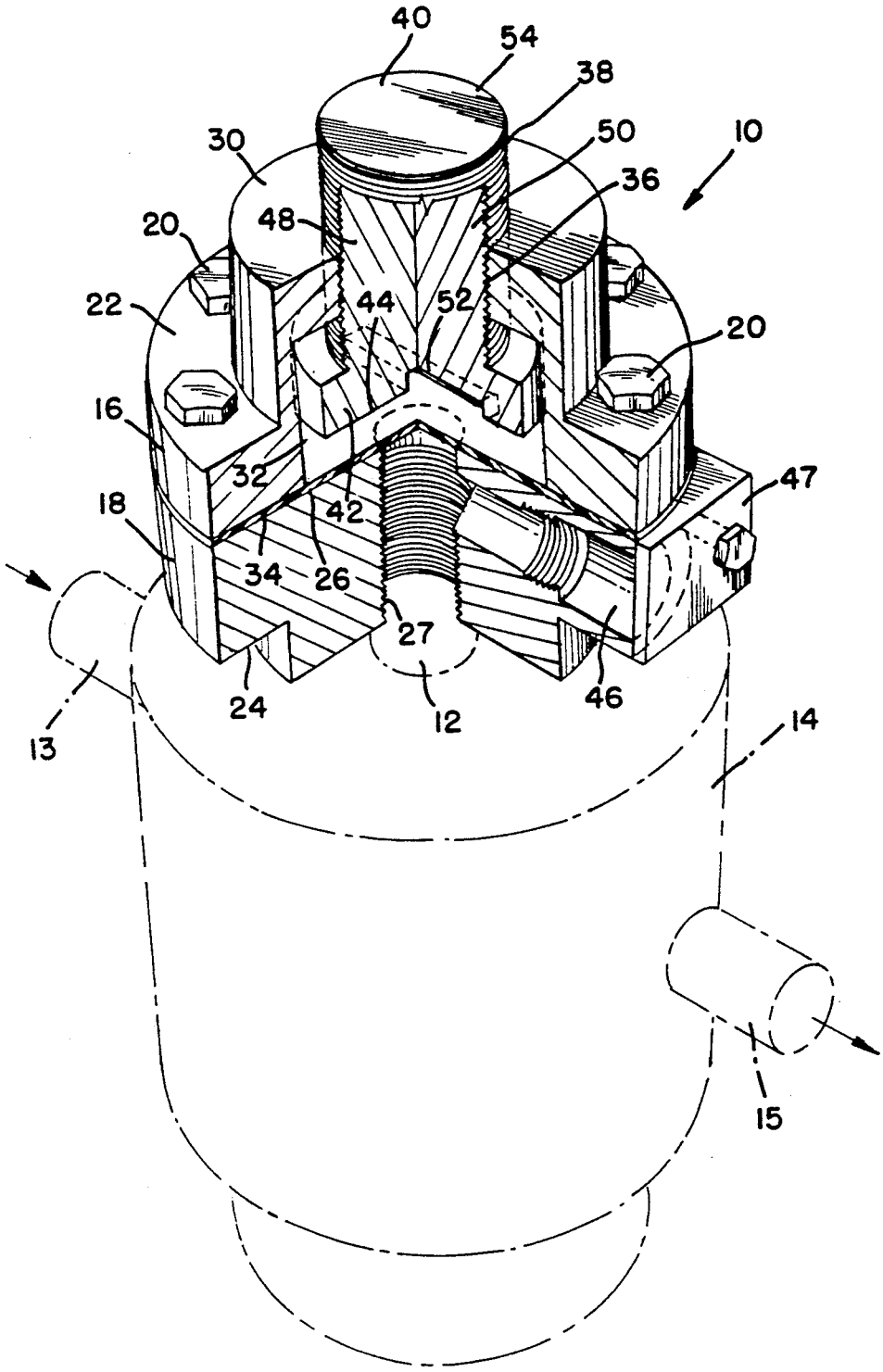
FIG. 1 is a perspective view partly in section of a preferred embodiment of the invention.

Referring now to the drawings wherein like reference numerals refer to like parts, reference is first made to FIG. 1 where there is shown a preferred embodiment of the invention and one comprising an auxiliary or secondary fluid chamber assembly 10 which is coupled to a primary pumping chamber 12 located, for example in the upper portion of a liquid dispensing pump 14 shown by the phantom lines and having an intake port 13 and an output port 15. The purpose of the secondary chamber is to provide a variable volumetric output for the pump 14 whose output is set for a predetermined fixed volume of delivery. Typically, such apparatus is used in connection with a post-mix beverage dispenser, not shown, which is utilized to dispense two liquids such as a concentrate and a diluent to a mixing valve in a predetermined ratio.

The secondary chamber assembly 10 shown in FIG. 1 is comprised of a pair of upper and lower body members 16 and 18 which might also be referred to as outer and inner body members. The body members 16 and 18 are fastened together by means of a plurality of threaded bolts 20 which pass through a top flat shoulder section 22 on the periphery of the upper body member 16 which pass through respective throughholes and attach to threaded nuts 23 as shown, for example, in FIG. 2A located on the bottom shoulder portion 24 on the outer perimeter of the lower body member 18.

Figure 2A:
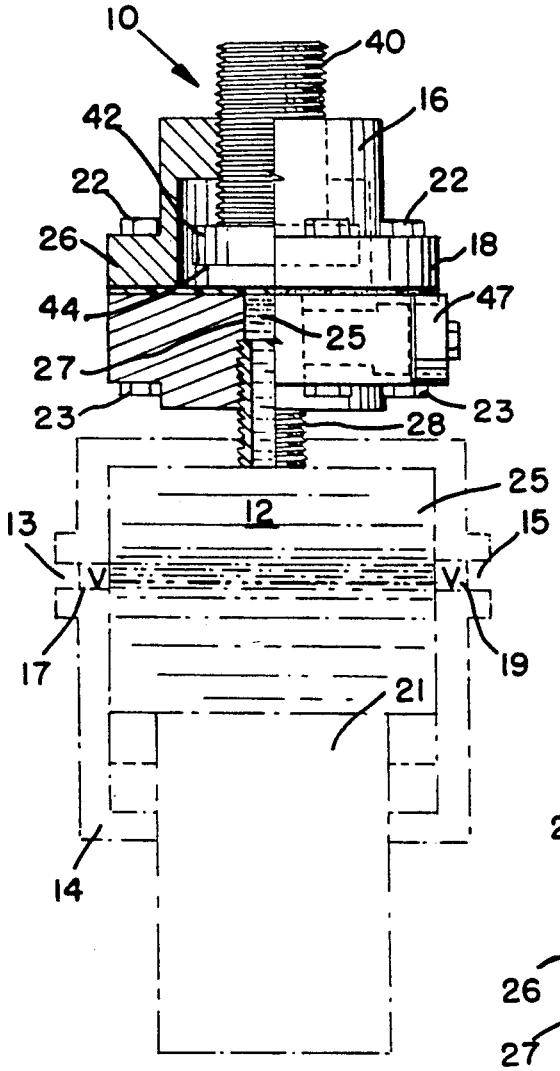
FIGS. 2A-2E are side elevational views partially in section and coupled to a pumping chamber shown in phantom view for illustrating the operation of the embodiment shown in FIG. 1.

Between the upper and lower body members 16 and 18 is located an expandable element in the form of a resilient diaphragm 26 which is adapted to be expanded or displaced upwardly by the volume of liquid being pumped from the pumping chamber 12 during an output stroke of the pump 14 and which is coupled to the underside thereof by means of a threaded central axial bore 27 in the lower body member 18 to which is affixed a coupling member such as shown by reference numeral 28 in FIG. 2A.

The upper body member 16 includes an upper body portion 30 of generally circular transverse cross section which includes a circular recess or cavity 32 which extends to the bottom surface 34 which is in contact with the diaphragm 26. The upper body portion 30 also includes a threaded bore 36 for receiving a threaded outer end portion 38 of a stop member 40 resembling a screw and having an inner end portion 42 of a relatively larger diameter and including a flat inner face 44 which has for its purpose providing an abutment for restricting i.e. stopping the expansion or translation of the diaphragm 2 outward due to the influence of the liquid being pumped during the output stroke of the pump 14. During the intake stroke, fluid is returned to the pumping cylinder 12, causing the diaphragm 26 to relax and return to its rest position as shown in FIG. 1.

The lower body member 18 is also shown including a normally closed radial bore 46 which connects to an axial bore 27 and includes a side a cover plate 47 which is bolted to the outside of the lower body member. The purpose of the radial bore 46 is to provide a means for cleaning the interior of the apparatus where it is used in connection with a concentrate pump or when desirable it can be used as a test port. Also the stop member 40 is shown constructed of two pieces 48 and 50, which are held together by a pin 52 and having an end cap 54.

Figure 2B:
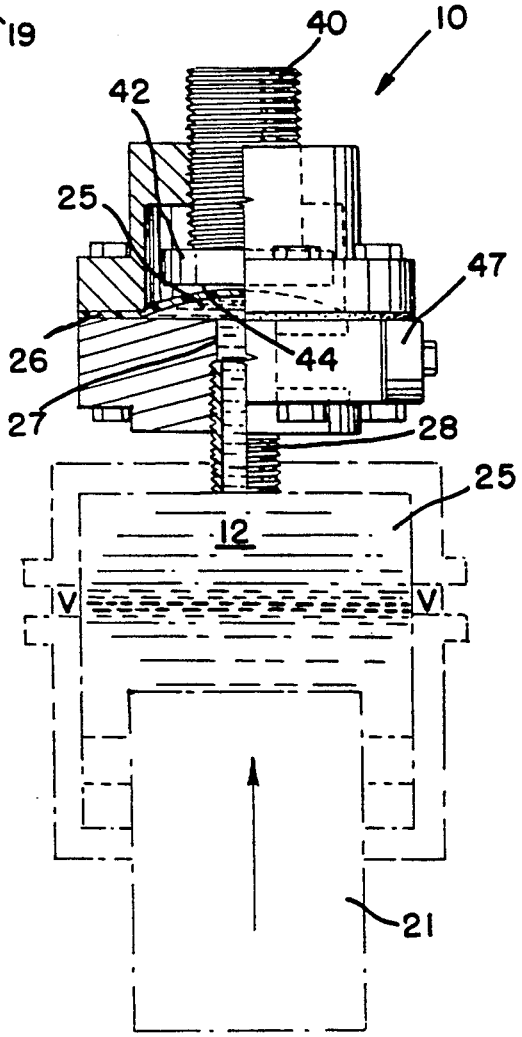
Figure 2C:
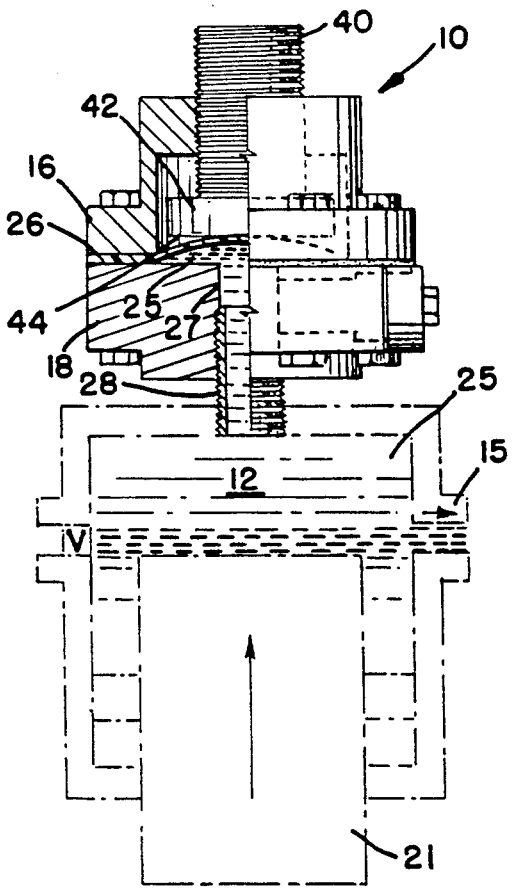

Reference will now be made to FIGS. 2A through 2E which are intended to illustrate the operation of the secondary fluid chamber assembly 10 so as to convert an otherwise fixed output pump 14 into a variable output pump. As shown in the Figures, the intake and output ports 13 and 15 are coupled to the pumping chamber 12 through the respective suction and discharge check valves 17 and 19. A reciprocating piston 21 operates to implement an intake stroke and an output stroke. FIG. 2B, for example, is illustrative of the beginning of an output stroke where the piston 21 begins moving inward in the pumping chamber 12 toward the diaphragm 26. This causes fluid 25 inside the pumping chamber 12 to be forced upward through the coupling 28 into the bore 27 to the underside of the rolling diaphragm 26. As shown, the liquid 25 causes the diaphragm 26 to flex upwardly toward the abutment portion 42 of the stop member 40. As the piston 21 continues its output stroke as shown in FIG. 2C, the diaphragm continues to flex until it strikes the undersurface 44 of the abutment portion 42 of the stop member 40, limiting the amount of liquid 25 which can be transferred thereto from the pumping chamber 12. The remainder is forced out of the output port 15.

Figure 2D:
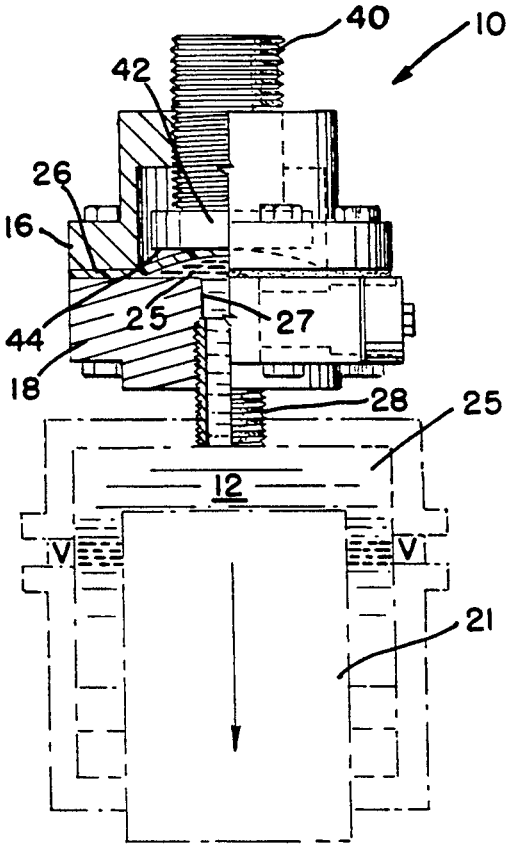
Figure 3:
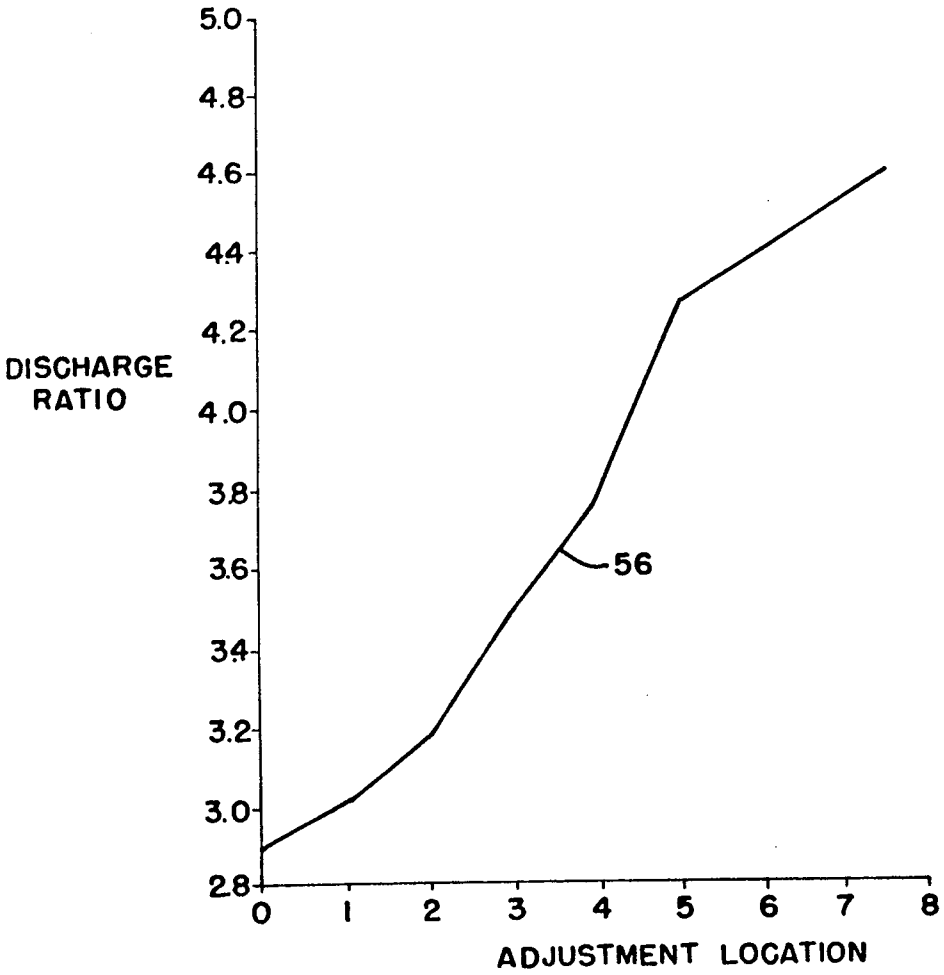
FIG. 3 is a characteristic curve illustrative of the variable volumetric output provided by the embodiment shown in FIG. 1.
Figure 2E:
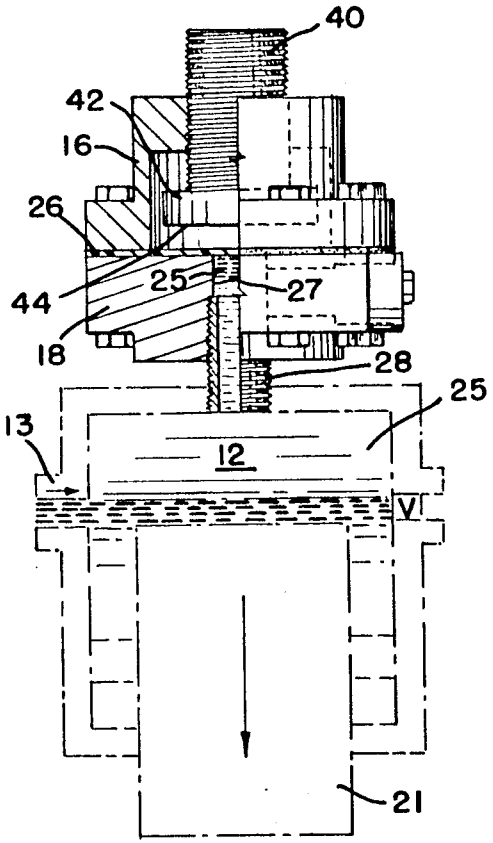

As shown in FIG. 2D, when the piston 21 begins its intake stroke, liquid 25 will be drawn back into the pumping chamber 12 and the diaphragm 26 slackens and pulls away from the abutment 42. As shown in FIG. 2E, as the intake stroke continues, the piston 21 draws liquid into the chamber 12 via the intake port 13. The diaphragm 26 will thereafter flatten out as shown and actually may thereafter flex slightly into the bore 27. It can be seen that by moving the stop member 40 toward and away from the diaphragm 26, the net output from the pump 14 will be determined by the position of the stop member 40 and more particularly the adjusted position of the stop member 40. The output characteristic of the pump 14 is shown in FIG. 3. There the curve 56 depicts the relationship of the discharge or output vs. the adjustment location of the stop member 40.

Figure 4:
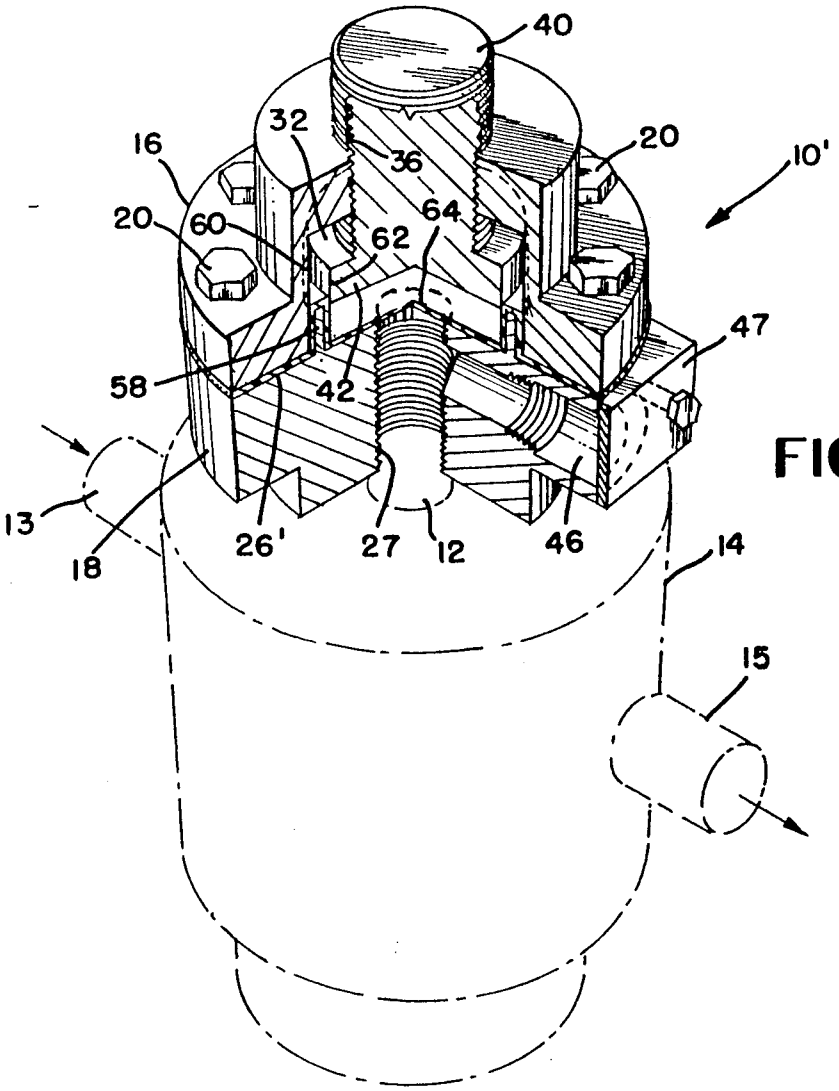
FIG. 4 is a perspective view partially in section of another preferred embodiment of the invention.
Figure 5:
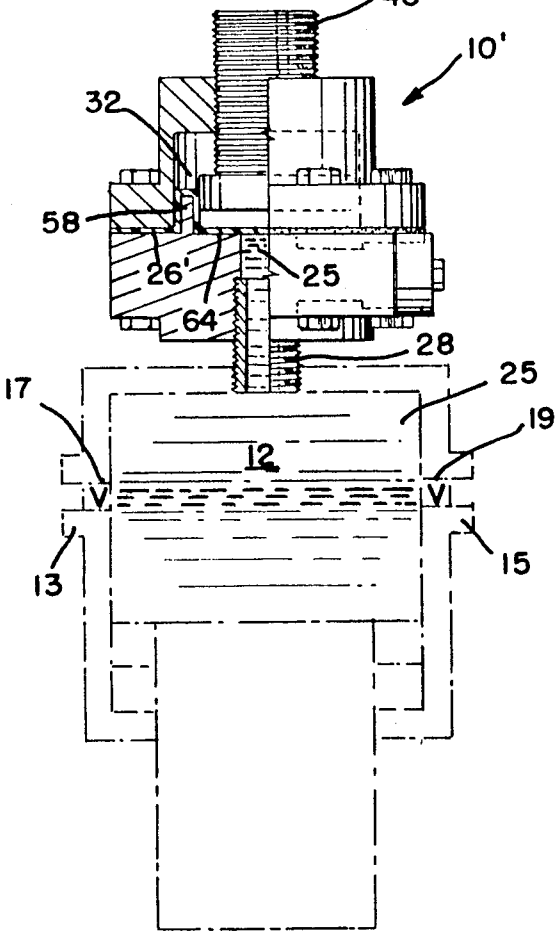
FIG. 5 is a side elevational view partially in section further illustrative of the embodiment shown in FIG. 4.

Referring now to FIGS. 4 and 5, shown thereat is another preferred embodiment of the subject invention which is substantially like the embodiment shown in FIG. 1 with the exception that the lower body member 18 now includes an outwardly extending circular flange 58 which when fastened to the upper body member 18, projects into the cavity 32 of the upper body member 16 where it resides intermediate the inner wall surface 60 of the upper body member 16 and the outer peripheral surface 62 of the end or abutment portion 42 of the stop member 40, which is also shown in cross section as a unitary solid body member. Additionally, the diaphragm which is now shown by reference numeral 26', instead of being a flat planar member 26 as shown in FIG. 1, now folds around the circular flange 58 where it extends outwardly and inwardly between the upper and lower body members as before.

Thus adjustment of the threaded stop member 40 by turning it clockwise causes it to descend into the cavity 32 inside of the flange 84 and the portion of the diaphragm 26' covering the flange 84. Counterclockwise rotation causes the stop member 40 to retract therefrom. However, the inner portion 64 of the diaphragm 26' acts in the same manner as the free portion of the diaphragm 26 shown in FIG. 1.

Thus what has been shown and described is a means for converting a fixed output pump to a selectively adjustable output pump. This now obviates the need, in a post-mix beverage dispensing system, for installing a different pump with a new preset ratio output for any change in type of syrup concentrate requiring a mixture adjustment.

It should be noted that the foregoing detailed description has been made by way of illustration and not limitation. Accordingly, all modifications, alterations and changes coming within the scope of the invention as defined in the following claims are herein meant to be included.

We claim:

1. Apparatus for providing a variable volumetric output of a pump having a primary pumping chamber coupled to an input port and an output port, comprising:

a variable volume secondary chamber in fluid communication with the primary pumping chamber for receiving a predetermined portion of a fluid being pumped from the pumping chamber during an output stroke and returning said portion of fluid to the pumping chamber during an intake stroke, said secondary chamber including, a recess located in at least one of two mutually fastened body members, said body members comprising an inner member and an outer body member, rolling diaphragm means located between and secured by said two body members for being displaced by the volume of fluid entering the secondary chamber, a stop member for selectively restricting the displacement of said means for controlling the volume of fluid receivable from the pumping chamber and thereby controlling the output from the pump by controlling the net internal pump chamber volume, said stop member further being adjustable toward and away from a central portion of the diaphragm for controlling the maximum displacement of the diaphragm during the output stroke of the pump and including an inner end portion having a generally flat face for contacting the central portion of the diaphragm and a body portion extending from said inner end portion and including a threaded outer end portion, and wherein said outer body member includes a threaded bore for engaging said threaded outer end portion of said stop member for controlling the displacement of the diaphragm.

2. The apparatus as defined by claim 1 wherein said recess comprises a circular bore located in said outer body portion.

3. The apparatus as defined by claim 2 wherein said inner end portion of said stop member for controlling the displacement of said diaphragm comprises a generally flat circular member axially movable in said bore.

4. The apparatus as defined by claim 3 wherein said generally flat circular member has a transverse cross sectional diameter substantially less than the inner diameter of said bore, wherein said inner body member has an outwardly extending circular flange located between said diameters, and wherein an outer portion of said diaphragm folds around said circular flange and extends outwardly between said inner and outer body members of said second chamber.

* * * * *